US010984742B2

(12) United States Patent
Nagasawa

(10) Patent No.: US 10,984,742 B2
(45) Date of Patent: Apr. 20, 2021

(54) SEMICONDUCTOR DEVICE

(71) Applicant: RENESAS ELECTRONICS CORPORATION, Tokyo (JP)

(72) Inventor: Kazuhiro Nagasawa, Tokyo (JP)

(73) Assignee: RENESAS ELECTRONICS CORPORATION, Tokyo (JP)

( * ) Notice: Subject to any disclaimer, the term of this patent is extended or adjusted under 35 U.S.C. 154(b) by 0 days.

(21) Appl. No.: 16/743,440

(22) Filed: Jan. 15, 2020

(65) Prior Publication Data

US 2020/0243029 A1 Jul. 30, 2020

(30) Foreign Application Priority Data

Jan. 28, 2019 (JP) ..... JP2019-011905

(51) Int. Cl.
*G09G 5/00* (2006.01)
*G09G 3/36* (2006.01)

(52) U.S. Cl.
CPC ..... *G09G 3/3614* (2013.01); *G09G 3/3688* (2013.01); *G09G 2310/0291* (2013.01); *G09G 2310/08* (2013.01)

(58) Field of Classification Search
CPC .. G09G 3/3688; G09G 3/3685; G09G 3/3696; G09G 3/3614; G09G 3/36; G09G 2310/08; G09G 2310/0291; G09G 2320/0257
See application file for complete search history.

(56) References Cited

U.S. PATENT DOCUMENTS 6,271,685 B1 * 8/2001 Nagasawa ..... H03K 19/01735 326/113
6,873,312 B2 * 3/2005 Matsueda ..... G09G 3/2011 345/90
10,152,439 B2 * 12/2018 Nagasawa ..... G06F 13/24
2002/0145602 A1 * 10/2002 Matsueda ..... G09G 3/3688 345/213
2002/0149556 A1 * 10/2002 Matsueda ..... G09G 3/2011 345/98
2018/0240422 A1 8/2018 Omura et al.

FOREIGN PATENT DOCUMENTS

JP 2018-132716 A 8/2018

* cited by examiner

*Primary Examiner* — Vijay Shankar
(74) *Attorney, Agent, or Firm* — McDermott Will & Emery LLP

(57) ABSTRACT

A display control device comprises an output unit that outputs an inverted polarity of an AC signal in a constant cycle, based on a signal of the constant cycle; a stop control unit that stops the reversal of the polarity of the AC signal in the output unit, based on a stop signal; a rewrite control unit for outputting a display data rewrite signal; and a transmission control unit for controlling the rewrite control unit. The stop signal stops the reversal of the polarity of the AC signal during a period in which the display data rewrite signal is output. The AC signal stopped by the stop signal maintains a polarity before the stop of polarity reversal. The output unit inverts and outputs the polarity of the AC signal, based on the signal of the constant cycle, after a period in which the display data rewrite signal is output.

9 Claims, 13 Drawing Sheets

SEMICONDUCTOR DEVICE

CROSS-REFERENCE TO RELATED APPLICATIONS

The disclosure of Japanese Patent Application No. 2019-011905 filed on Jan. 28, 2019 including the specification, drawings and abstract is incorporated herein by reference in its entirety.

BACKGROUND OF THE INVENTION

The present disclosure relates to a semiconductor device, and more particularly, to a microcontroller or the like for controlling a displayed device.

In a display device using a liquid crystal display panel, a technique is known in which a potential (VCOM potential) supplied to a common electrode of a pixel is temporally changed in order to prevent a screen burn-in (also called screen image sticking). Patent Document 1 discloses that "when the timing at which the polarity should be reversed is within the period in which the image data is output, the CPU 101 changes the timing to a timing after the period.
There are disclosed techniques listed below.

[Patent Document 1] Japanese Unexamined Patent Application Publication No. 2018-132716

SUMMARY OF THE INVENTION

A semiconductor device such as a microcontroller performs a display data rewriting operation in order to rewrite display data displayed on the display device. The display data rewriting operation needs to be performed so as to satisfy the specifications of the display device. If the display data rewriting operation does not satisfy the specifications of the display device, the display quality of the display device may deteriorate.

An object of the present invention is to provide a technique for suppressing deterioration in display quality of a display device and rewriting display data on the display device.

The other objects and new features of the present invention will become apparent from the description of this specification and the accompanying drawings.

An outline of a typical one of the present invention will be briefly described as follows.

The semiconductor device of the present invention includes a display control device, the display control device comprising:

based on a signal of a constant cycle, an output unit that outputs the inverted polarity of an AC signal in the period;

based on a stop signal, a stop control unit that stops the reversal of the polarity of the AC signal in the AC signal output unit;

a rewrite control unit for outputting a display data rewrite signal; and a transmission control unit for controlling the rewrite control unit.

Further, in the period when the display data rewrite signal is output, the stop signal stops the reversal of the polarity of the AC signal. The AC signal whose polarity inversion has been stopped maintains the polarity before the polarity inversion is stopped. After the period when the display data rewrite signal is output, the output unit inverts the polarity of the AC signal in the cycle based on the signal having a constant cycle and outputs the inverted signal.

According to the semiconductor device of the present invention, it is possible to rewrite display data on the display device while suppressing a decrease in display quality of the display device.

DESCRIPTION OF THE PREFERRED EMBODIMENTS

Figure 1:
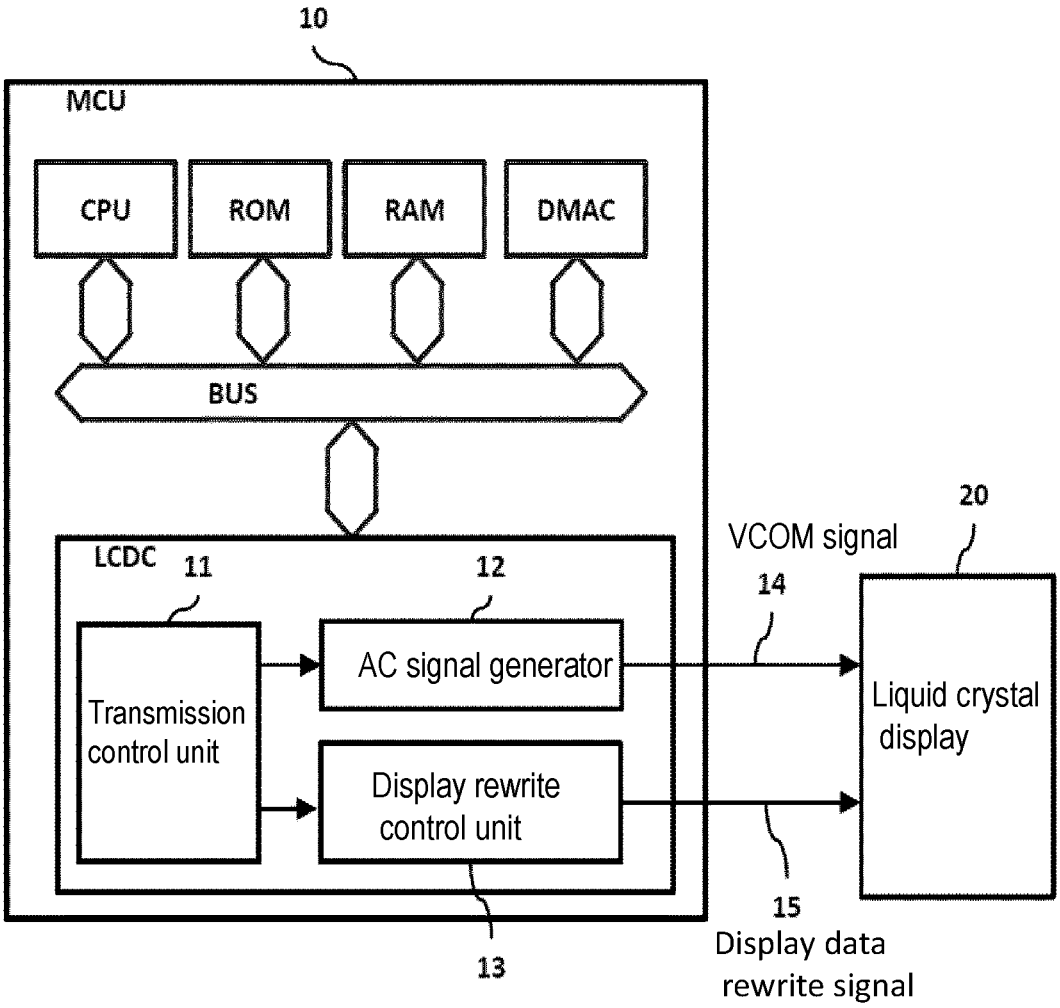
FIG. 1 is a diagram showing a semiconductor system according to Embodiment 1.

Hereinafter, embodiments will be described with reference to the drawings. However, in the following description, the same components may be denoted by the same reference numerals and repeated description may be omitted. In addition, although drawing may be represented typically compared with an actual aspect in order to clarify description more, it is an example to the last and does not limit the interpretation of this invention.

Embodiment 1

FIG. 1 is a diagram illustrating a semiconductor system according to the first embodiment. The semiconductor system 1 is an electronic device having a display panel such as an electronic timepiece, a tag device that displays product prices, and the like. The semiconductor system 1 includes a semiconductor device 10, a liquid crystal display device 20 having a display panel.

The semiconductor device 10 is a microcontroller MCU, for example, a semiconductor integrated circuit device that is formed on a semiconductor substrate such as single crystal silicon by using a CMOS transistor manufacturing method technique. The microcontroller MCU as the semiconductor device 10 includes a central processing unit CPU as a control unit, a nonvolatile memory ROM, a volatile memory RAM, a data transfer control device DMAC, a display control device LCDC, and a bus BUS. The bus BUS interconnects mutually the central processing unit CPU, the nonvolatile memory ROM, the volatile memory RAM, the data transfer control device DMAC, and the display control device LCDC.

The central processing unit CPU is a processor that performs various arithmetic processes and controls the overall operation of the semiconductor system 1. The central processing device CPU reads out control programs from the nonvolatile memory ROM, stores the control programs in the volatile memory RAM, and performs various operation processes such as arithmetic control and display control related to various functions.

The nonvolatile memory ROM can be configured by, for example, a read-only memory, a flash memory, or the like. The nonvolatile memory ROM stores a control program, data required for calculation, initial setting data, and the like.

The volatile memory RAM can be configured by, for example, a static random access memory (SRAM) or a dynamic random access memory (DRAM). Volatile memory RAMs are used, for example, as temporary data storage areas for central processing device CPUs that execute control programs.

The data transfer control device DMACs can be configured by, for example, a direct memory access controller. The Data Transfer Control device DMACs control the transfer of data directly between memory or between memory and peripheral circuits or devices without the intervention of Central Processing device CPUs. The data transfer control device DMACs can be used to transfer display data to be displayed on the liquid crystal display device 20.

The display control device LCDCs are peripheral circuits for controlling the liquid crystal display device 20, and include a transmit control unit 11, an AC signal generation unit 12, and a rewrite control unit 13. The transmission controller 11 controls the operations of the AC signal generator 12 and the rewrite controller 13.

The AC signal generator 12 generates the VCOM signal 14 and outputs the signal 14 to the LCD device 20. The VCOM signals 14 are used to prevent burn-in of the screens of the liquid crystal display panels provided in the liquid crystal display device 20. The VCOM signal 14 is, in one instance, an alternating-voltage signal whose polarities are periodically reversed. The LCD device 20 changes the polarity of the common potential (VCOM potential) supplied to the common electrodes of the plurality of pixels from the positive potential to the negative potential or from the negative potential to the positive potential based on the reversal times of the polarities of the VCOM signals 14.

Rewriting control unit 13 generates a display data rewriting signal 15, and outputs to the liquid crystal display device 20. The display data rewrite signal 15 includes, for example, display data to be rewritten, a synchronization signal, a write enable signal, and the like. The liquid crystal display device 20 rewrites the display data of the corresponding plurality of pixels in the liquid crystal display device 20 based on the display data rewrite signals 15.

The liquid crystal display device 20 is a display device having liquid crystal display panels. The liquid crystal display device 20 may be, for example, a Memory In Pixel liquid crystal device including memory elements in which each of a plurality of pixels stores display data. Compared to a typical Thin Film Transistor liquid crystal device, the MIP liquid crystal device does not require frequent rewriting, and the MIP liquid crystal device 1 can consume less power.

Figure 2:
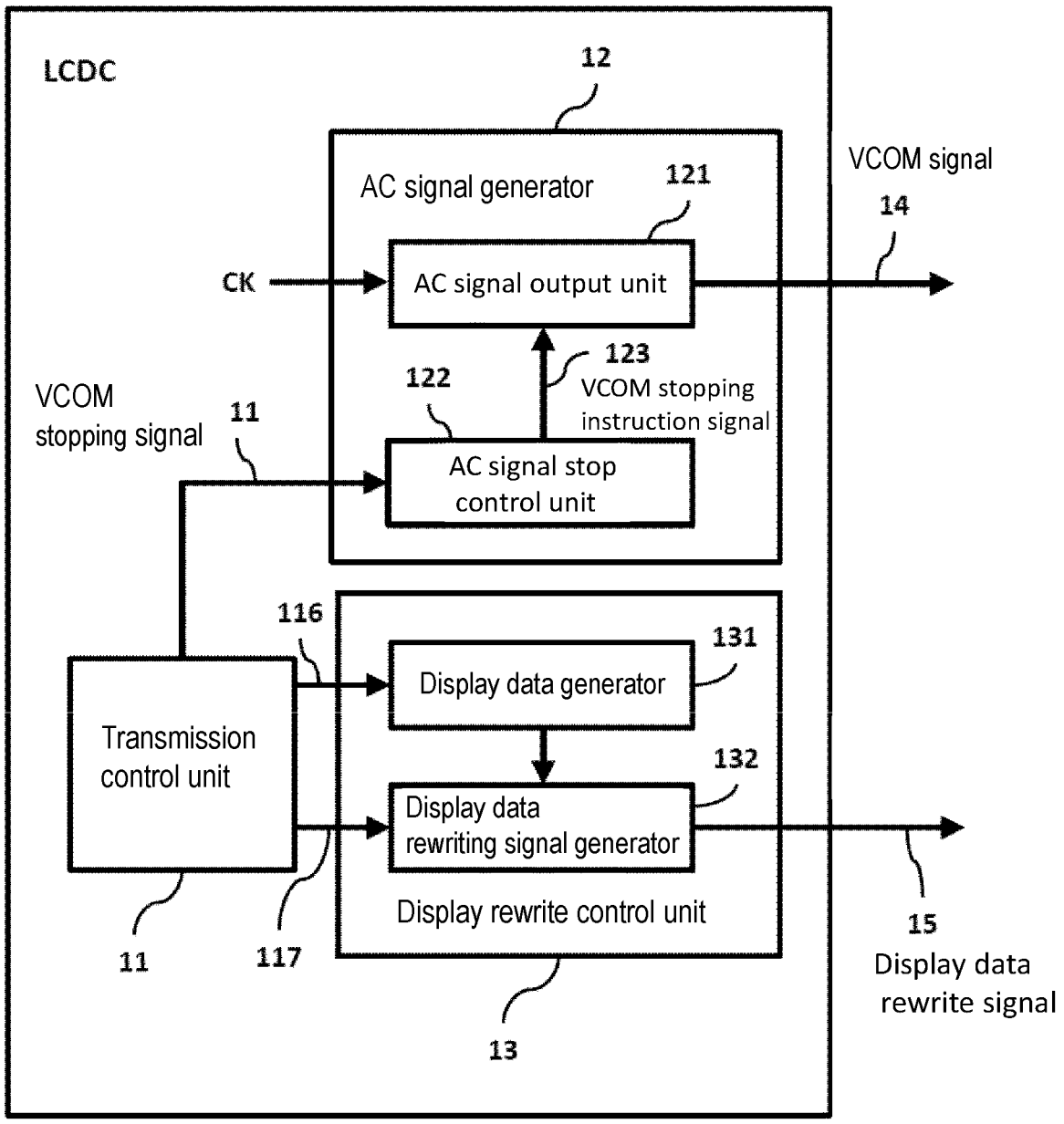
FIG. 2 is a diagram for explaining a conceptual configuration of the display control device of FIG. 1.

FIG. 2 is a diagram for explaining a conceptual configuration of the display control device of FIG. 1. As shown in the display control device LCDC of FIG. 2, the AC signal generating unit 12 includes an AC signal outputting unit 121 and an AC signal stopping control unit 122. The AC signal outputting unit 121 generates the VCOM signal 14 having a predetermined cycle based on the AC signal generating clock CK and sends the generated clock CK to the LCD device 20. Based on the VCOM stop signal 111 generated by the transmission control unit 11, the AC signal stop control unit 122 transmits a VCOM stop instruction signal 123 for stopping the change of the polarities of the VCOM signals 14 to the AC signal outputting unit 121. The AC signal outputting unit 121 is configured to stop the change of the polarities of the VCOM signals 14 based on the VCOM stop instructing signal 123.

The rewrite control unit 13 includes a display data generation unit 131 and a display data rewrite signal generation unit 132. The display data rewriting signal 15 generated by the display data generating unit 131 and the display data rewriting signal generating unit 132 is transmitted to the liquid crystal display device 20.

The transmission control unit 11 outputs the display rewrite data 116 to the display data generation unit 131, and outputs the transmission start instruction signal 117 to the display data rewrite signal generation unit 132.

Figure 3:
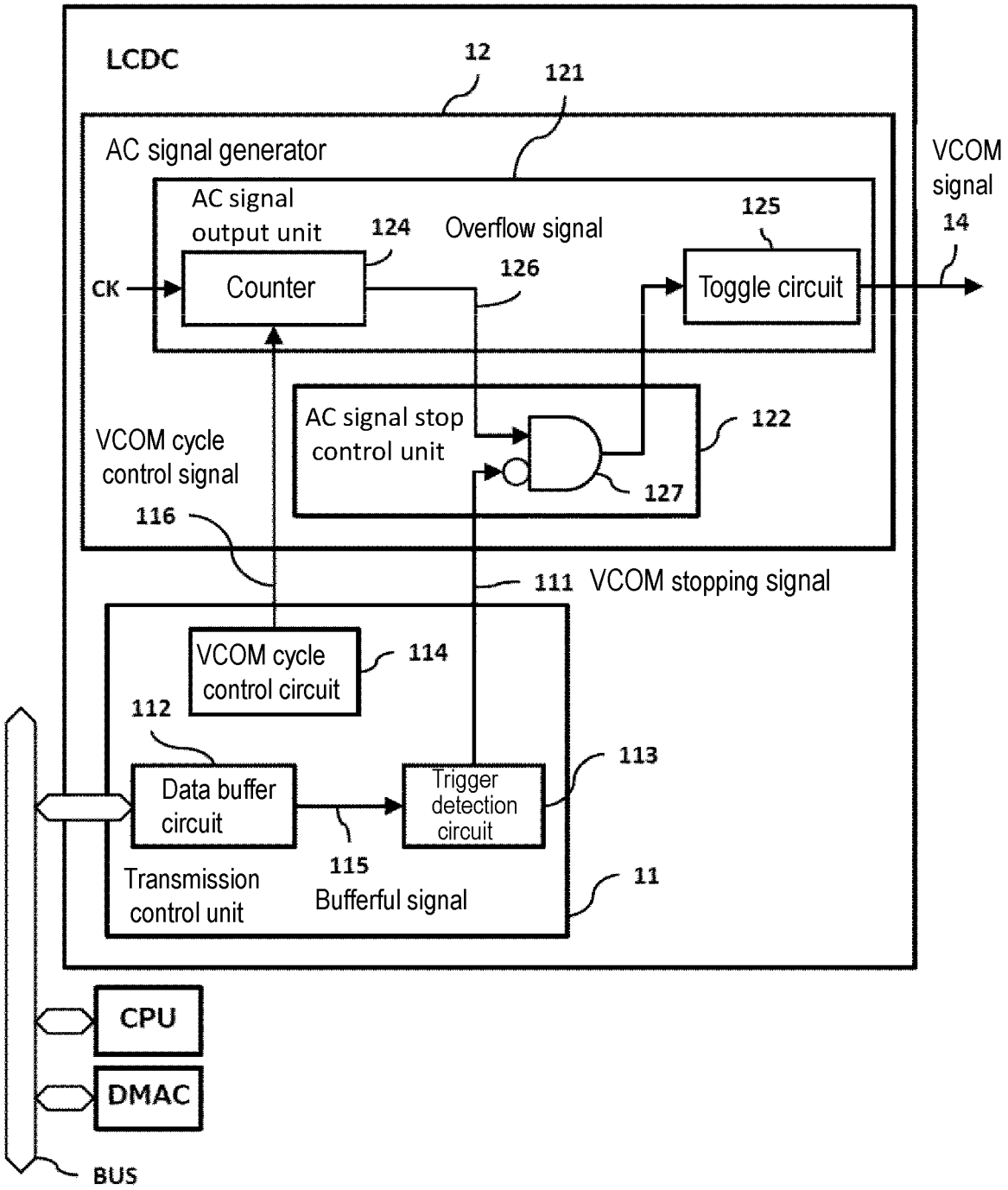
FIG. 3 is a diagram showing configuration details of a transmission control unit, AC signal output unit, and AC signal stop control unit shown in FIG. 2.

FIG. 3 is a diagram showing a detailed configuration example of the transmission control unit 11, the AC signal output unit 121, and the AC signal stop control unit 122 of FIG. 2.

The transmit control unit 11 includes a data buffer circuit 112, a trigger detection circuit 113, and a VCOM cycle control circuit 114. The data buffer circuit 112 is connected to the bus BUS, and the central processing device CPU or the data transfer control device DMAC stores the display rewrite data in the data buffer circuit 112. The data buffer circuit 112 generates the bufferful signal 115 when the writing amount of the display rewrite data matches the storage capacity of the data buffer circuit 112. When the bufferful signal 115 is inputted to the trigger detection circuit 113, the trigger detection circuit 113 issues the VCOM stop signal 111 to the AC signal stop control circuit 122. The VCOM period control circuitry 114 is provided to control the reference count values of the counters 124. The reference count values of the counters 124 can be set by the VCOM cycle controller 114 based on the type of the LCD device 20 connected to the semiconductor device 10.

The AC signal output unit 121 includes a counter 124 and a toggle circuit 125. The AC signal stop control unit 122 includes an AND circuit 127. The counter 124 counts the AC signal generation clock CK, and generates, for example, a high-level overflow signal 126 when the count value of the AC signal generation clock CK matches the reference count value. The counter 124 resets the count value of the AC signal generation clock CK based on the generation of the overflow signal 126, and starts counting the AC signal generation clock CK again. The AND circuit 127 has a first input to which the overflow signal 126 is input, and a second input to which the inverted signal of the VCOM stopping signal 111 is input. The output of the AND circuit 127 is connected to the input of the toggle circuit 125, and the output of the toggle circuit 125 is the VCOM signal 14.

When the VCOM stopping signal 111 is set to the high level, the AND circuit 127 prohibits outputting the overflow signal 126 of the high level to the toggle circuit 125. Therefore, when the VCOM halt signal 111 is set to the high level, the polarity of the VCOM signal 14, which is the output of the toggle circuit 125, is not changed and the polarity of the toggle circuit 125 is maintained.

Next, the operation will be described. When the display data of the liquid crystal display device 20 is rewritten, the data buffer circuit 112 is rewritten in order to update the display rewrite data by the central processing device CPU or the data transfer control device DMAC. The trigger detection circuit 113 receives the bufferful signal 115 or the like generated by rewriting the data buffer circuit 112, and the transmission control unit 11 issues the VCOM stop signal 111 to the AC signal stop control unit 122.

The AC signal stop control unit 122 stops the operation of changing the polarities of the VCOM signals 14 in response to the VCOM stop signal 111. At this time, since the counter 124 continues the counting operation based on the AC signal generation clock CK, the counter 124 maintains the change timing of the polarity inversion of the VCOM signal 14 without being affected by the VCOM stopping signal 111. In other words, the overflow signal 126 of the counter 124, which determines the change timing of the polarity inversion of the VCOM signal 14, is continuously outputted at a predetermined period (T).

By stopping the operation of changing the polarity inversion of the VCOM signal 14, i.e., holding the VCOM signal 14, the display data of the liquid crystal display device 20 can be rewritten without restricting the change of the polarity inversion of the VCOM signal 14 with respect to the liquid crystal display device 20.

In addition, the counter 124 of the AC signal outputting unit 121 may vary the reference count value (overflow count value) by the VCOM cycle control circuit 114, thereby avoiding the continuation of the stoppage of the operation of changing the polarity of the VCOM signal 14 with respect to the transmission of the constant cycle (T). That is, the output timing of the overflow signal 126 may be determined in consideration of the transmission of the display rewrite data of a predetermined cycle. It is preferable to determine the reference count value so that the update period of the display/rewrite data does not overlap with the change operation of the polarity inversion of the VCOM signal 14. The reference count value is configured to be changeable by the VCOM cycle control circuit 114 in order to correspond to various electronic device and various liquid crystal display device. In one embodiment, the reference count value may be set by the VCOM period control circuit 114 such that the period T of the polarities of the VCOM signals 14 is 0.5, 1, 2, or 5 seconds. Although not particularly limited, it is assumed that the reference count value once determined for one electronic device is not changed. However, the reference count value once determined may, of course, be changed.

Figure 4:
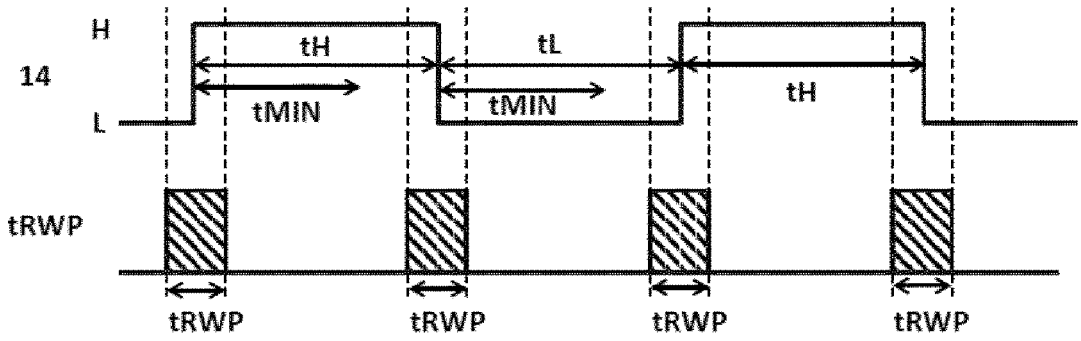
FIG. 4 is a diagram for explaining specifications of LCD device 20 of FIG. 1.

Next, specifications of the LCD device 20 will be described. FIG. 4 is a diagram for explaining the specifications of the LCD device 20 shown in FIG. 1. In the LCD device 20, the minimum value (tMIN) of the high-level width (or period) tH and the low-level width (or period) tL of the VCOM signals 14 may be specified as specifications. In this instance, the width (or period) tH of the high level and the width (or period) tL of the low level of the VCOM signals 14 need to be set to the smallest value (tMIN) or more (tH>tMIN, tL>tMIN). If the widths tH of the high level and the widths tL of the low level of the VCOM signals 14 become widths (or periods) equal to or less than the prescribed minimum values (tMIN) (tH<tMIN, tL<tMIN), the liquid crystal display device 20 cannot maintain the characteristics of the liquid crystal, and the display quality of the liquid crystal display device 20 may deteriorate.

In some cases, before and after the polarities of the VCOM signals 14 are reversed, rewrite prohibition periods tRWP for prohibiting rewrite of displayed data are specified as specifications. That is, the rewrite prohibition period tRWP is provided before and after each of the inversion timing of the polarity of the VCOM signal 14 transitioning from the low level to the high level and the inversion timing of the polarity of the VCOM signal 14 transitioning from the high level to the low level. If the display data is rewritten in the rewrite prohibition term tRWP, the display data may be lost or the display data may not be displayed normally. Therefore, the displayed data needs to be rewritten during the rewriting prohibition period tRWP.

Figure 5:
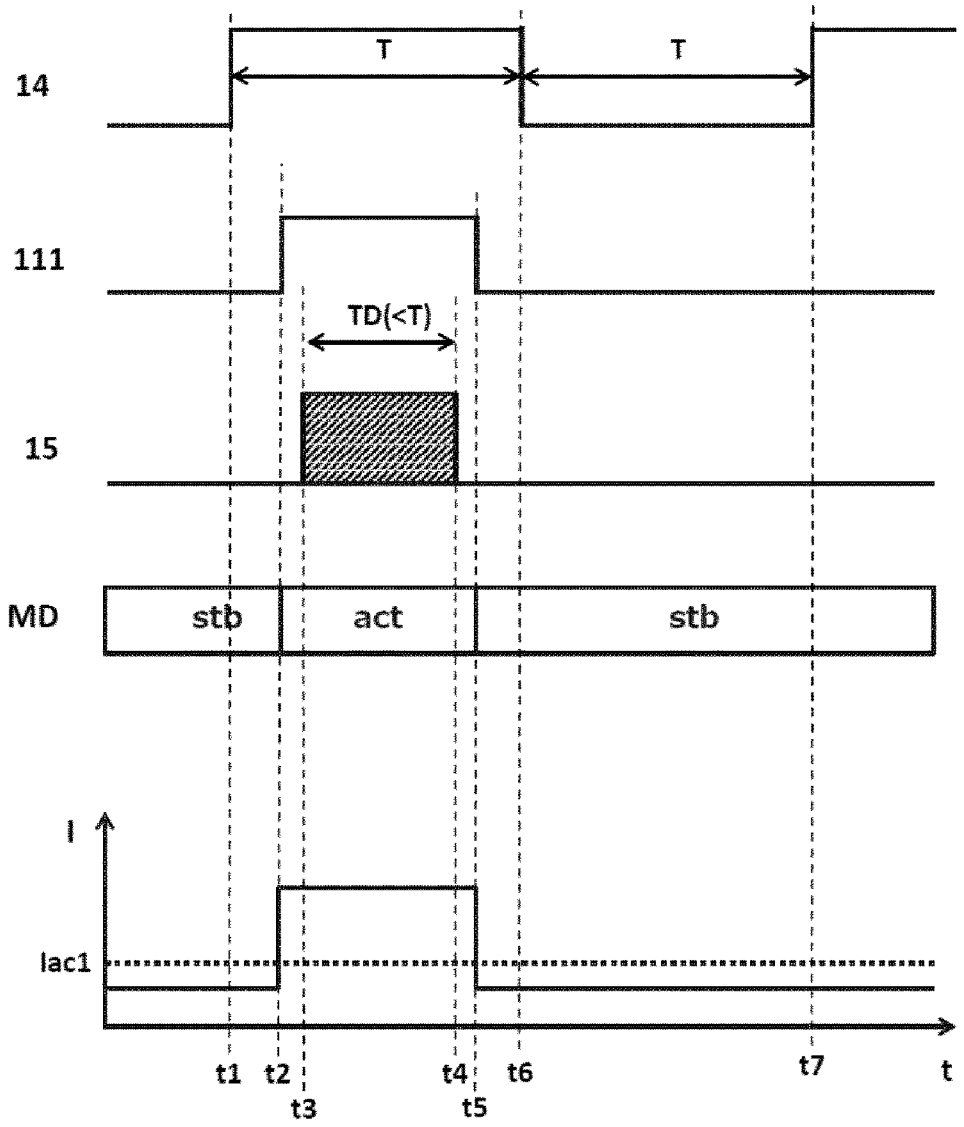
FIG. 5 is a diagram illustrating a case where the polarity inversion timings of the display data rewrite signal and the VCOM signal do not overlap.
Figure 6:
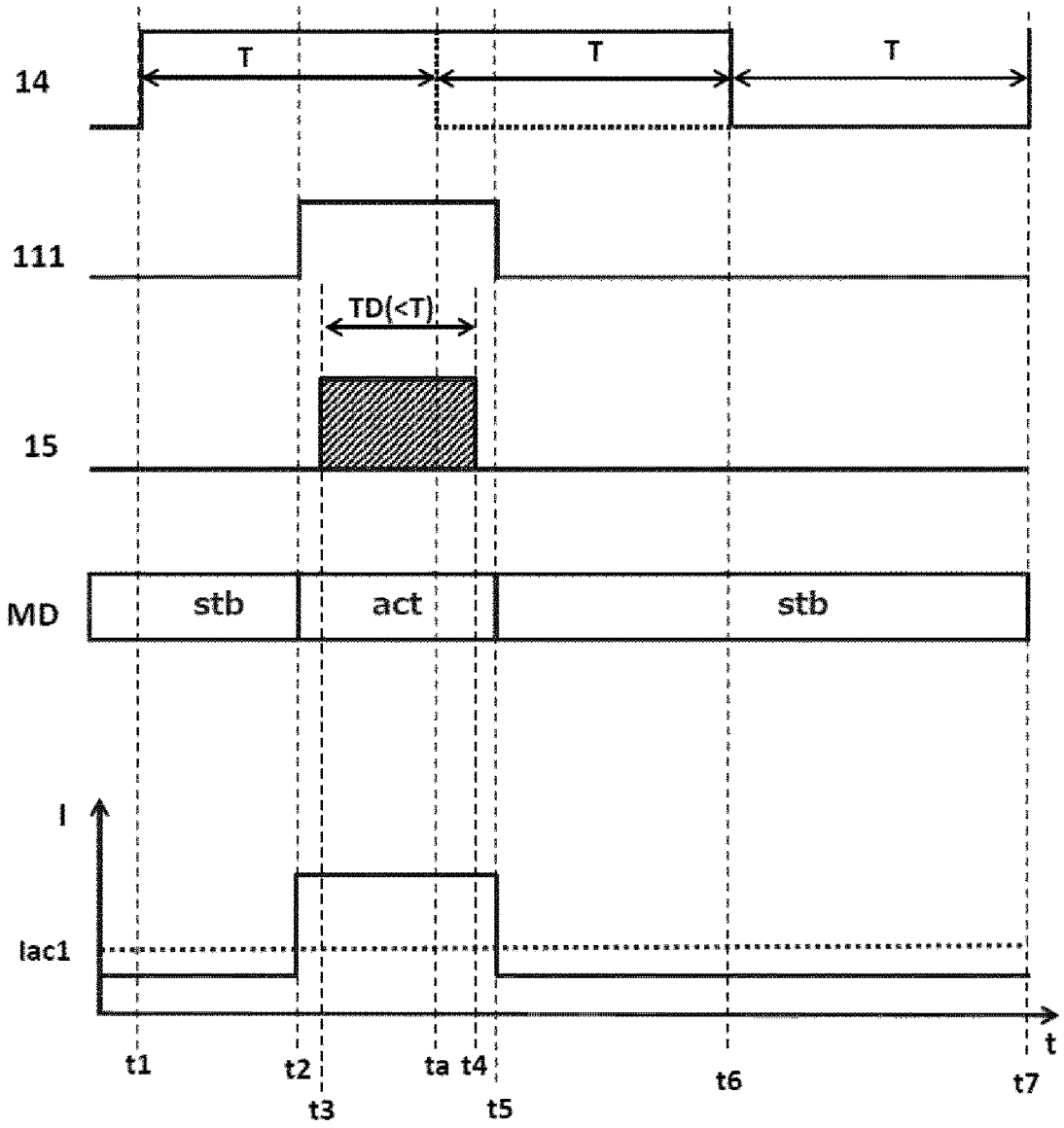
FIG. 6 is a diagram illustrating a case where the polarity inversion timings of the display data rewrite signal and the VCOM signal overlap.

Next, a relationship between periods of the display-data rewrite signal and invert times of polarities of the VCOM signal 14 will be described. FIG. 5 is a diagram showing the case where the display-data rewriting signal 15 and the polarities of the VCOM signal 14 do not overlap with each other. FIG. 6 is a diagram showing the case where the display-data rewriting signal 15 and the polarities of the VCOM signal 14 overlap with each other. It should be noted that FIGS. 5 and 6 satisfy the specifications of the liquid crystal display device 20 described with reference to FIG. 4.

Referring to FIG. 5, the VCOM signals 14 have inversion timings at which their polarities are inverted at times t1, t6, and t7. Each of the reversal timings of the polarities of the VCOM signal 14 is based on the generation timing of the overflow signal 126 of the timer circuit 124 and occurs at a predetermined period T. The period T is longer than the minimum value (tMIN) in FIG. 4 (T>tMIN).

At time t2, the VCOM stopping signal 111 transitions from the low level to the high level, and from time t3 to time t4, the display-data rewriting signal 15 is outputted to the liquid crystal display device 20. Note that the period TD (a period from time t3 to time t4) during which the display data rewriting signal 15 is output is made shorter than the period T (TD<T). In FIG. 5, the period from time t1 to time t2 is set longer than the period (tRWP/2) of half of the rewrite prohibition period tRWP in FIG. 4.

At time t5, the VCOM stop signal 111 transitions from the high level to the low level, and the display-data rewriting is completed. The transition of the VCOM stopping signal 111 from the high level to the low level may be a transition at time t4 when the output of the display-data rewriting signal 15 is completed. In FIG. 5, the period from time t5 to time t6 is set longer than the period (tRWP/2) of half of the rewrite prohibition period tRWP in FIG. 4.

In FIG. 5, the operation mode MD of the microcontroller MCU as the semiconductor device 10 shifts from the standby state stb, which consumes low power, to the active state act at time t2, and shifts from the active state act to the standby state stb at time t5. That is, in this embodiment, the microcontroller MCU transitions to the active state act intermittently or selectively during the high-level period of the VCOM stop signal 111, and the microcontroller MCU is placed in the low-power standby state stb during the remaining period. Therefore, the power consumption I of the microcontroller MCU is increased in the period of the active state act compared to the period of the standby state stb. In FIG. 5, Iac1 represents the mean power dissipation of the microcontroller MCU and is kept low. Therefore, when the microcontroller MCU is driven by a battery such as a battery, since the average power consumption of the microcontroller MCU can be reduced by shortening the data rewriting time, the driving time of the microcontroller MCU by the battery can be relatively lengthened.

Referring to FIG. 6, the VCOM signals 14 have inversion timings at which their polarities are inverted at times t1, t6, and t7. However, the overflow signal 126 of the timer circuit 124 is generated at the time ta (t 3 4), but the inversion of the polarities of the VCOM signal 14 is suppressed by the polarity-level VCOM stopping signal 111, so that the high level of the VCOM signal 14 is maintained from the time t1 to the time t6. Therefore, the display-data rewriting operation is not blocked by the inversion of the polarities of the VCOM signals 14 at the time ta, and the display-data rewriting operation is reliably performed between the time t3 and the time t4. The other operations are the same as those in FIG. 5, and therefore description thereof is omitted. In FIG. 6, each of the period from the time t1 to the time t2 and the period from the time t5 to the time t6 is longer than the half period (tRWP/2) of the rewrite prohibition period tRWP in FIG. 4.

As described above, even when the display-data rewrite signal 15 and the VCOM signal 14 are reversed at the time ta, the AC signal stop control unit 122 stops the change of the VCOM signal 14 by the VCOM stop signal 111 issued from the transmission control unit 11. By stopping the polarity change of the VCOM signal 14, the state of the VCOM signal 14 sent to the liquid crystal display device 20 is held at the high level or the low level, the restriction of the liquid crystal display device 20 due to the state of the VCOM signal 14 is eliminated, and the display data can be rewritten at any time. As a result, the duration of the active state act of the microcontroller MCU can be minimized without being extended. Therefore, the average current consumption of the entire semiconductor system 1 can be reduced. As a result, when the microcontroller MCU is driven by a battery such as a battery, since the average power consumption of the microcontroller MCU can be reduced by shortening the data rewriting time, the driving time of the microcontroller MCU by the battery can be relatively lengthened.

Figure 7:
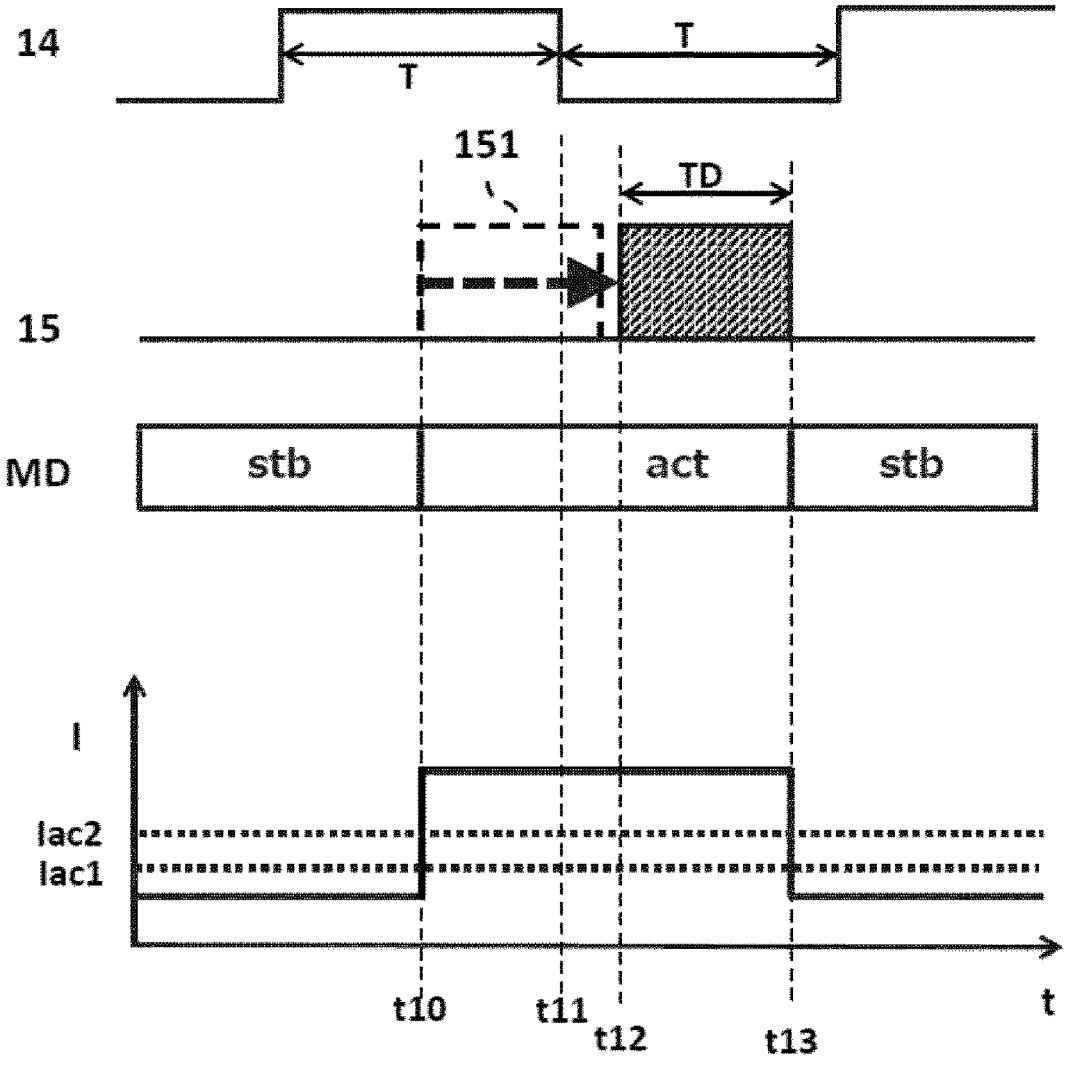
FIG. 7 is a diagram illustrating a case where the polarity inversion timings of the display data rewrite signal and the VCOM signal according to the comparative example overlap.

FIG. 7 is a diagram showing a case where the inverted timing of the polarity of the display data rewriting signal 15 and the VCOM signal 14 according to the comparative example overlaps. In the comparative examples, although the display data rewrite signal 151 is attempted to be output at time t10 as indicated by the dotted line, since the polarity inversion timing of the VCOM signal 14 occurs at time t11, the start of output of the display data rewrite signal 15 is changed to be delayed to time t12 after time t11, and the display data rewrite operation is performed from time t12 to time t13. In this case, the active state act of the microcontroller MCU will be extended, such as between time t10 and time t13. Therefore, the average current Iac2 of the entire semiconductor system 1 increases (Iac2>Iac1). For example, the microcontroller MCU can perform the operation as shown in FIG. 7 by providing the microcontroller MCU with a monitoring circuit for monitoring the timing of inversion of the polarities of the VCOM signals 14, and changing the starting time of outputting the display-data rewriting signal based on the monitoring result of the monitoring circuit.

Figure 8:
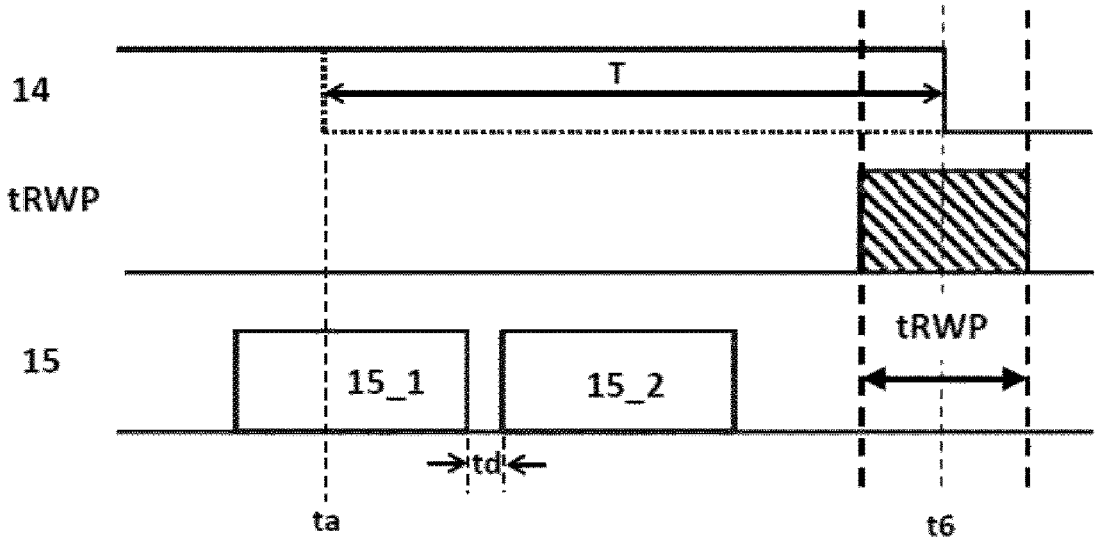
FIG. 8 is a diagram for explaining a case where the display data rewriting operation of a plurality of times according to the first embodiment is performed intermittently.
Figure 9:
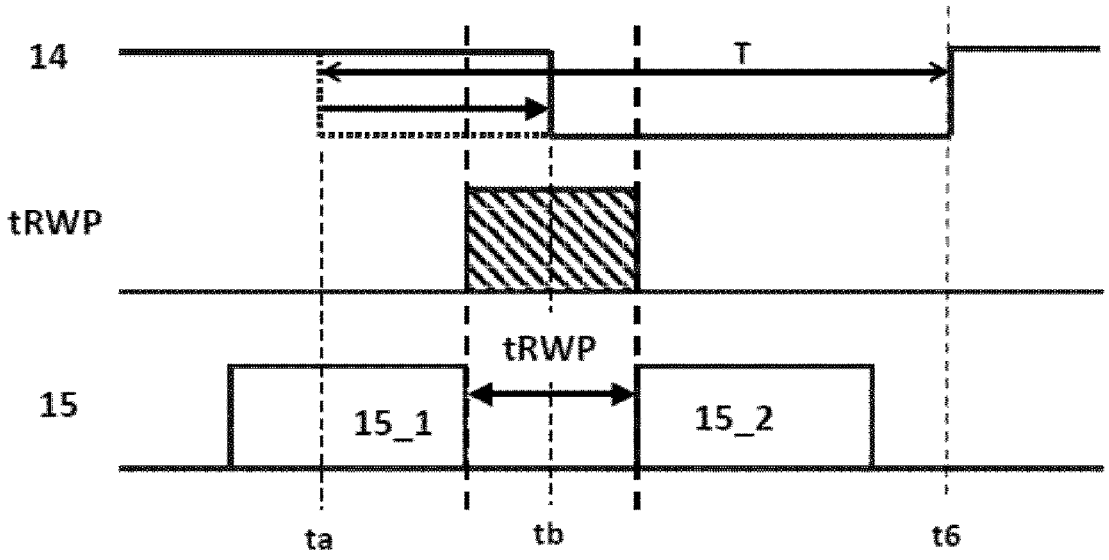
FIG. 9 is a diagram illustrating a case where display data rewriting operations of a plurality of times according to Comparative Example 2 are performed intermittently.

FIG. 8 is a diagram illustrating a plurality of display-data rewriting operations performed intermittently according to the Embodiment 1. FIG. 9 is a diagram for explaining a case where a plurality of display data rewriting operations according to Comparative Example 2 are performed intermittently.

In the VCOM signal 14 shown in FIG. 8, as described with reference to FIG. 6, the overflow signal 126 of the timer circuit 124 is generated at the time ta, but the inversion of the polarities of the VCOM signal 14 is suppressed by the VCOM stopping signal 111 of the high level, and the high level of the VCOM signal 14 is maintained from the time ta to the time t6. At time t6, since the VCOM signal 14 has a polarity inversion timing at which the signal 14 transitions from the high level to the low level, as described with reference to FIG. 4, a rewrite prohibition period tRWP for prohibiting rewriting of the displayed data is provided before and after the inversion timing.

Consider a case where the rewriting operation of the display data is performed intermittently and continuously twice. For example, after the first output of the display data rewriting signal 15_1 is completed, the second output of the display data rewriting signal 15_2 is started after a predetermined time has elapsed. In this instance, the time td between the completion of the output of the first display data rewrite signal 15_1 and the commencement of the output of the second display data rewrite signal 15_2 can be set to a relatively short time (shortest time) without considering the rewrite prohibition time tRWP.

FIG. 9 shows a case where the rewriting operation of the display data is intermittently and continuously performed twice as in FIG. 8. Since the VCOM signal 14 shown in FIG. 9 overlaps with the output period of the first display-data rewriting signal 15_1 at the time ta, the inversion timing of the polarity of the VCOM signal 14 transitioning from the high level to the low level is changed from the time ta to the time tb. This configuration can be referred to, for example, a technique described in Japanese Patent Laid-Open No. 2018-132716. As described with reference to FIG. 4, when the rewriting prohibition period tRWP for prohibiting rewriting of display data is provided before and after the inversion timing of the time tb, the output of the second display data rewriting signal 15_2 is started after the completion of the output of the first display data rewriting signal 15_2 and after the elapse of the rewriting prohibition period tRWP. Therefore, the time (tRWP) between the completion of the output of the first display data rewrite signal 15_1 and the commencement of the output of the second display data rewrite signal 15_2 becomes longer (tRWP>td) compared to the configuration (td) illustrated in FIG. 8.

According to Embodiment 1, the first display data rewriting operation and the second display data rewriting operation can be intermittently and continuously performed in a relatively short time.

Figure 10:
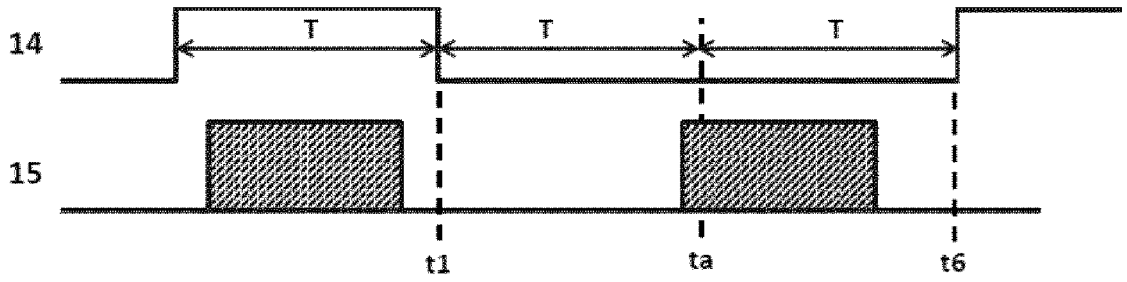
FIG. 10 is a diagram for explaining the display-data rewriting operation according to the Embodiment 1.
Figure 11:
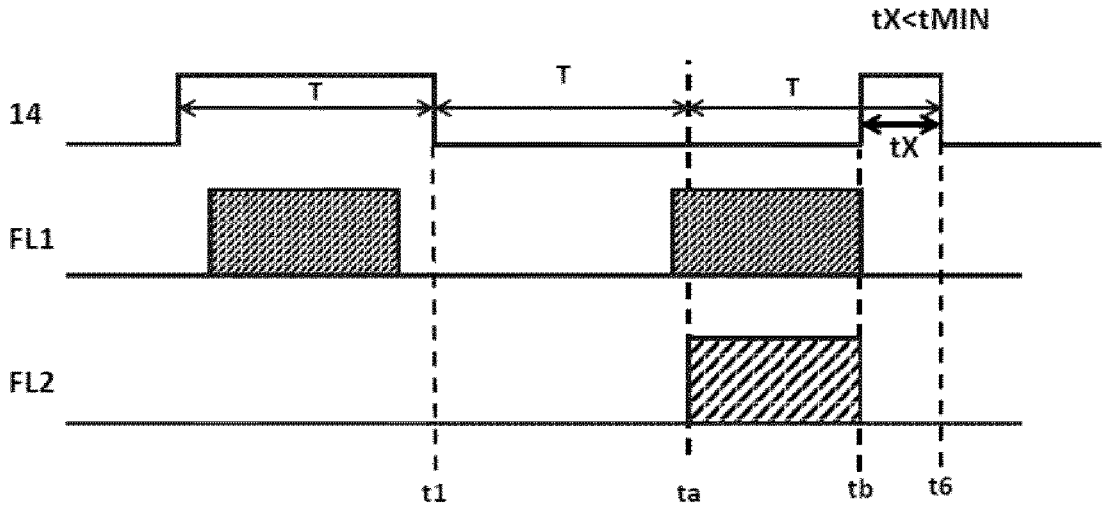
FIG. 11 is a diagram for explaining a display data rewriting operation according to Comparative Example 3.

FIG. 10 is a diagram for explaining a display-data rewriting operation according to the Embodiment 1. FIG. 11 is a diagram for explaining a display data rewriting operation according to Comparative Example 3.

In the VCOM signal 14 shown in FIG. 10, as described with reference to FIG. 6, the overflow signal 126 of the timer circuit 124 is generated at the time ta, but the inversion of the polarities of the VCOM signal 14 is suppressed by the high-level VCOM stopping signal 111, and the low level of the VCOM signal 14 is maintained from the time ta to the time t6. Between the time t1 and the time ta, and between the time ta and the time t6, the period T is set based on the generation timing of the overflow signal 126 output from the timer circuit 124. That is, since the period T is constant, as described with reference to FIG. 4, the width (or period) tH of the high level and the width (or period) tL of the low level of the VCOM signals 14 are set to the smallest value (tMIN) or more. In addition, since the period T of the VCOM signal 14 is always N times the prescribed period (N is a positive integer), in the specifications of the liquid crystal display device, the width (or period) tH of the high level and the width (or period) tL of the low level of the VCOM signal 14 need not consider the lower limit value (minimum value tMIN).

Since the VCOM signal 14 shown in FIG. 11 overlaps with the output period of the display-data rewriting signal 15_1 at the time ta, the inversion timing of the polarity of the VCOM signal 14 transitioning from the low level to the high level is changed from the time ta to the time tb. The VCOM signal 14 also has a polarity-inverted timing at which the signal transitions from a high level to a low level at time t6. Here, the cycle T is constant between the time t1 and the time ta, and between the time ta and the time t6. This configuration can be referred to, for example, a technique described in Japanese Patent Laid-Open No. 2018-132716. The FL1 corresponds to the flag indicating that the image data is being outputted, and the FL2 corresponds to the polarity-unchanged flag. As described in FIG. 4, the high-level width (or period) tH and the low-level width (or period) tL of the VCOM signals 14 need to be set to a minimum value (tMIN) or more. However, as shown in FIG. 11, the period between the time tb and the time t6 (the width (or period) of the high level of the VCOM signals 14) may become equal to or less than the minimum value (tMIN) if the period of outputting the image data is set to be relatively long. Therefore, it is considered that the liquid crystal display device 20 cannot maintain the characteristics of the liquid crystal, and the display quality of the liquid crystal display device 20 may be deteriorated.

According to the Embodiment 1, since the widths of the VCOM signals 14 are not shorter than the specified widths, the original characteristics of the liquid crystal display device 20 can be maintained, and the deterioration of the display qualities of the liquid crystal display device 20 can be suppressed.

Embodiment 2

Although Embodiment 1 shows a configuration in which the change of the VCOM signal 14 is stopped by the VCOM stop signal 111 outputted from the transmission control unit 11, the present invention is not limited thereto. Embodiment 2 illustrates a configuration that allows the central processor device CPUs to halt changes in the VCOM signals 14 at any time by means of software programs executed by the CPUs.

Figure 12:
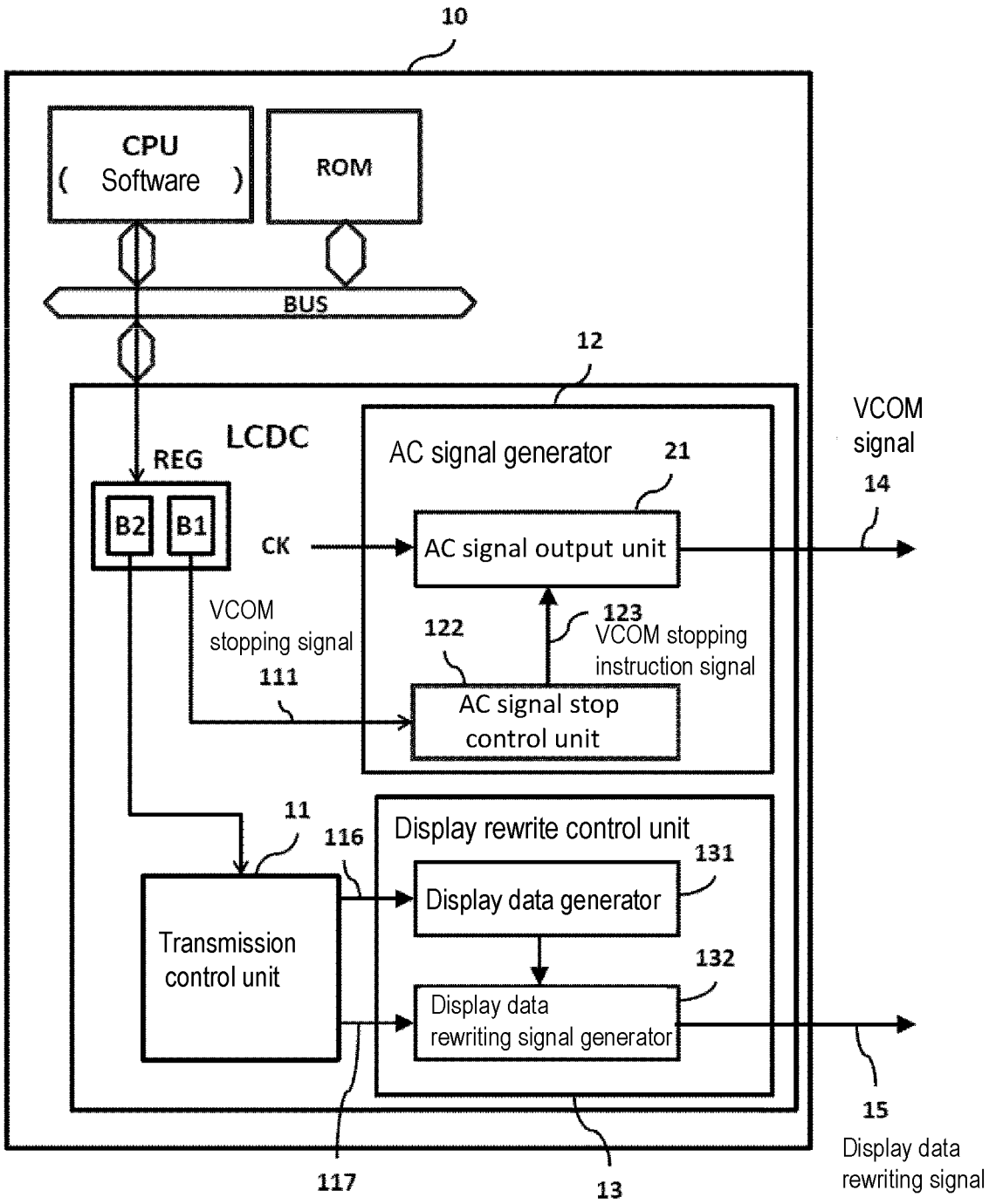
FIG. 12 is a diagram for explaining a conceptual configuration of the semiconductor device 10 according to Embodiment 2.

FIG. 12 is a diagram illustrating a conceptual configuration of the semiconductor device 10 according to the Embodiment 2. In FIG. 12, the volatile memory RAM and the data-transfer control device DMACs shown in FIG. 1 are omitted. The configuration of the display control device LCDCs of FIG. 12 differs from that of FIG. 2 in that the VCOM stop signals 111 can be outputted under the control of the central processor device CPUs executing software programs in FIG. 12. Accordingly, the display control device LCDCs are provided with control registers REGs which can be set by the central processing device CPUs via the buses BUSs. The control register REG is configured to include a first control bit B1 and a second control bit B2. The first control bit B1 is a bit for controlling the change of polarities of the VCOM signals 14 to be valid and invalid, and may be referred to as a VCOM stop control bit. The second control bit B2 is a control bit for instructing the transmission control unit 11 to start and complete the output of the display data rewriting signal 15. The rest of the configuration is the same as that of FIG. 2, and a description thereof will be omitted. The software program is stored in the nonvolatile memory ROM.

Figure 13:
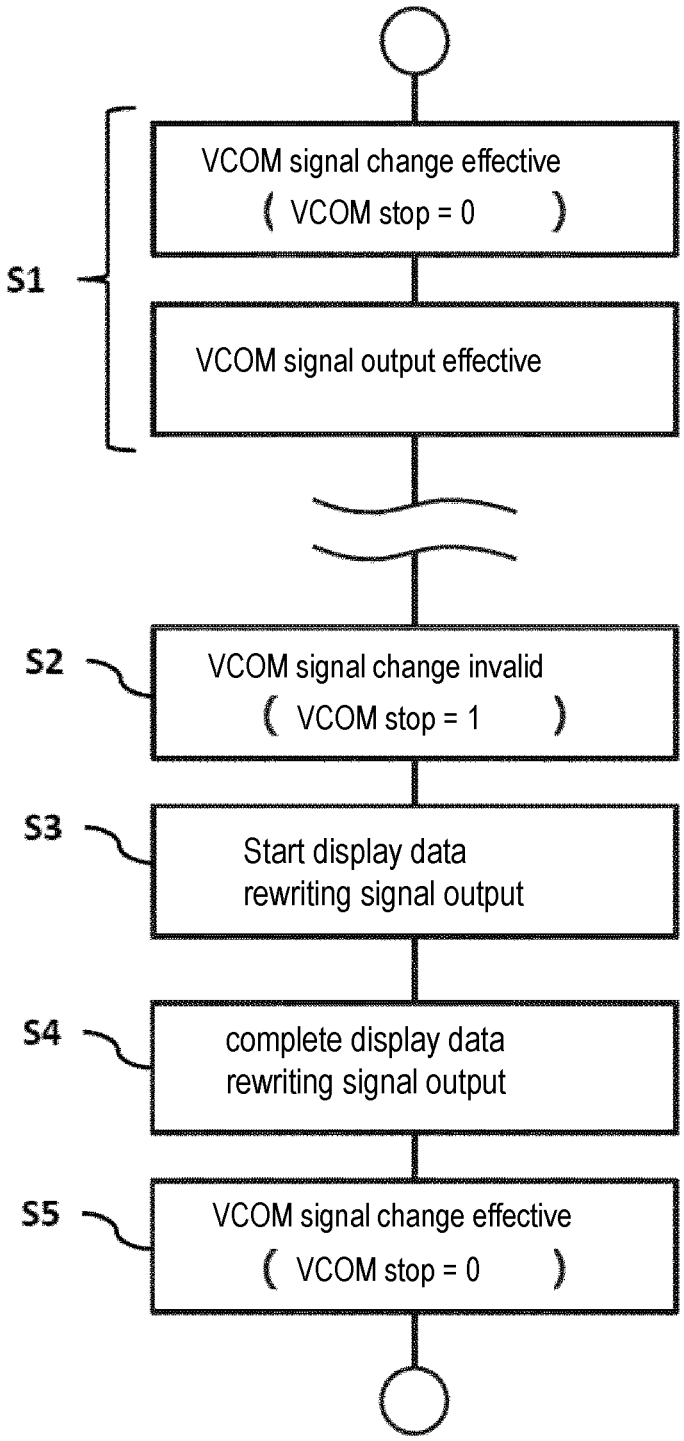
FIG. 13 is a diagram showing a control flow according to Embodiment 2.

FIG. 13 is a flowchart showing a control flow according to the Embodiment 2. The control flow shown in FIG. 13 enables stopping the change of the polarities of the VCOM signals 14 under the control of software programs executed by the central processing device CPU. In the Embodiment 2, the change of the polarities of the VCOM signals 14 can be stopped at any time regardless of the rewriting of the displayed data.

(Step S1) The polarity change of the VCOM signal 14 is validated (VCOM stop=0) and the VCOM signal 14 is outputted. The central processor device executing the software programs performs, for example, an operation of writing a value indicating validity (in one example, a value of 0 (zero)) to the first control bits B1 of the control register REG via the buses BUS.

(Step S2) The polarities of the VCOM signals 14 are invalidated (VCOM stop=1). The central processing device CPU executing the software program executes an operation of writing, for example, a value indicating invalidity, in one example, a value of 1, to the first control bit B1 of the control register REG via the bus BUS.

(Step S3) The output of the display data rewriting signal 15 is started. The central processing device CPU executing the software program performs the operation of writing, via the bus BUS, a value, in one example a value of 1, for example, to the second control bit B2 of the control register REG, the value indicating the start of the control register REG. As a result, the transmission control unit 11 outputs the display rewrite data 116 to the display data generation unit 131, outputs the transmission starting instruction signal 117 to the display data rewrite signal generation unit 132, and the rewrite control unit outputs the display data rewrite signal 15 to the liquid crystal display device 20.

(Step S4) The output of the display data rewriting signal 15 is completed. A central processing device CPU executing the software program executes an operation of writing a value (in one example, a value of 0 (zero)) indicating completion, for example, to the second control bits B2 of the control register REG via the bus BUS.

(Step S5) The polarity change of the VCOM signal 14 is validated (VCOM stop=0) and the VCOM signal 14 is outputted. The central processor device executing the software programs performs, for example, an operation of writing a value indicating validity (in one example, a value of 0 (zero)) to the first control bits B1 of the control register REG via the buses BUS. According to Embodiment 2, the stopping of the change of polarities of the VCOM signals 14 can be carried out under the control of software programs executed by the central processor device CPUs.

While the invention made by the present inventor has been specifically described above based on the Embodiment, the present invention is not limited to the embodiment and the Embodiment described above, and it is needless to say that the present invention can be variously modified.

What is claimed is:

1. A semiconductor device including a display control device, comprising:

an output unit that outputs an inverted polarity of an AC signal in a constant cycle, based on a signal of the constant cycle;

a stop control unit that stops the reversal of the polarity of the AC signal in the output unit, based on a stop signal;

a rewrite control unit for outputting a display data rewrite signal; and a transmission control unit for controlling the rewrite control unit, wherein the stop signal stops the reversal of the polarity of the AC signal during a period in which the display data rewrite signal is output, wherein the AC signal stopped by the stop signal maintains a polarity before the stop of polarity reversal, and wherein the output unit inverts and outputs the polarity of the AC signal, based on the signal of the constant cycle, after a period in which the display data rewrite signal is output.

2. The semiconductor device according to claim 1, wherein the output unit includes:

a timer circuit for counting clocks and generating an overflow signal at the constant cycle;

a toggle circuit for inverting the polarity of the AC signal at the constant cycle based on the overflow signal; and a stop control unit for stopping a supply of the overflow signal output from the timer circuit to the toggle circuit based on the stop signal.

3. The semiconductor device according to claim 2, wherein the transmission control unit includes a data buffer circuit and a trigger circuit, and the trigger circuit outputs the stop signal to the stop control unit based on a bufferful signal generated by the data buffer circuit.

4. The semiconductor device according to claim 3, further comprising a central processing device; and a data transfer control device, wherein the central processing device or the data transfer control device stores the display rewrite data in the data buffer circuit, and wherein the data buffer circuit generates the bufferful signal when a write amount of the display rewrite data matches a storage capacity of the data buffer circuit.

5. The semiconductor device according to claim 3, wherein the display control device includes a cycle control circuit, wherein the cycle control circuit sets a reference count value in the timer circuit, and wherein the timer circuit generates the overflow signal when a count value of the clock matches the reference count value.

6. The semiconductor device according to claim 2, wherein the stop control unit includes an AND circuit, and wherein the AND circuit has a first input to which the overflow signal is input, a second input to which an inverted signal of the stop signal is input, and an output connected to an input of the toggle circuit.

7. The semiconductor device according to 1, further comprising a central processing device and a non-volatile memory storing a program, wherein the stopping signal is generated by the central processing device executing the program.

8. The semiconductor device according to 7, wherein the display control device comprises a control register having a first control bit, and wherein the central processor device executing programs generates the stopping signals by writing values to the first control bit.

9. The semiconductor device according to 8, wherein the control register further comprises a second control bit, and wherein the central processor device executing the programs starts outputting the display-data rewriting signals by writing values to the second control bit.

* * * * *